United States Patent [19]

Hellsten et al.

[11] 4,358,368

[45] Nov. 9, 1982

[54] PROCESS FOR THE FROTH FLOTATION OF CALCIUM PHOSPHATE-CONTAINING MINERALS AND FLOTATION AGENTS THEREFOR

[75] Inventors: Karl M. E. Hellsten, Odsmal; Anders W. Klingberg, Henan, both of Sweden

[73] Assignee: Berol Kemi AB, Stenungsund, Sweden

[21] Appl. No.: 263,339

[22] Filed: May 13, 1981

Related U.S. Application Data

[63] Continuation of Ser. No. 17,010, Mar. 2, 1979, abandoned.

[51] Int. Cl.[3] ..... B03D 1/14

[52] U.S. Cl. ..... 209/167; 209/9; 252/DIG. 7; 252/61; 260/501.13

[58] Field of Search ..... 209/166, 167; 252/61, 252/DIG. 7; 260/501.11, 501.13

[56] References Cited

U.S. PATENT DOCUMENTS

| | | | |
|---|---|---|---|
| 1,761,546 | 6/1930 | Trattel | 209/166 |
| 1,952,907 | 3/1934 | Christmann | 209/166 |
| 2,120,217 | 6/1938 | Harris | 209/166 |
| 2,217,846 | 10/1940 | Olthner | 252/DIG. 7 X |
| 2,382,360 | 8/1945 | Weiner | 209/166 |
| 2,407,203 | 9/1946 | Cole | 209/166 |
| 2,414,199 | 1/1947 | Gotzent | 252/61 X |
| 3,755,435 | 8/1973 | Sundby | 260/501.11 X |
| 3,912,662 | 10/1975 | Martinsson | 252/DIG. 7 X |
| 4,070,276 | 1/1978 | Bruman | 209/166 |
| 4,081,363 | 3/1978 | Brayson | 209/166 |
| 4,110,207 | 8/1978 | Wang | 209/166 |

FOREIGN PATENT DOCUMENTS

| | | | |
|---|---|---|---|
| 697020 | 11/1964 | Canada | 209/166 |
| 2338324 | 8/1977 | France | 209/166 |
| 214798 | 8/1941 | Switzerland | 260/501.13 |
| 1355091 | 5/1974 | United Kingdom | 209/166 |
| 143745 | 7/1961 | U.S.S.R. | 209/166 |

OTHER PUBLICATIONS

Chem. Abst. vol. 72, 1970, 102789t.
Chem. Abst. vol. 75, 1971, 99542m.

*Primary Examiner*—Norman Yudkoff

[57] ABSTRACT

A process for the froth flotation of calcium phosphate-containing minerals is provided which comprises carrying out the flotation in the presence of an amphoteric flotation agent having the general formula:

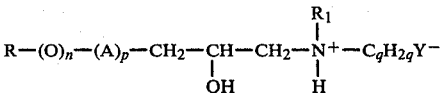

wherein:

R is a hydrocarbon group having from about seven to about twenty-four carbon atoms;

A is an oxyalkylene group having from two to about four carbon atoms;

$R_1$ is selected from the group consisting of hydrogen and hydrocarbon groups having from one to about four carbon atoms;

$Y^-$ is selected from the group consisting of $COO^-$ and $SO_3^-$;

n is a number from 0 to 1;

p is a number from 0 to 5;

q is a number from 1 to 2;

and salts thereof.

23 Claims, No Drawings

PROCESS FOR THE FROTH FLOTATION OF CALCIUM PHOSPHATE-CONTAINING MINERALS AND FLOTATION AGENTS THEREFOR

This is a continuation of application Ser. No. 17,010, filed Mar. 2, 1979, now abandoned.

Apatite is the name applied to any of a group of calcium phosphate minerals containing other elements or radicals (as fluorine, chlorine, hydroxyl, or carbonate), having the approximate general formula $Ca_5(F, Cl, OH, \frac{1}{2} CO_3)(PO_4)_3$, and occurring variously as hexagonal crystals, as granular masses, or in fine-grained often impure masses as the chief constituent of phosphate rock and of most or all bones and teeth. Exemplary apatites include fluoroapatite, carbonate apatite, chlorapatite and hydroxyl apatite.

The mineral occurs in the United States mainly in the form of the calcium phosphate ores that are referred to generically as phosphate rock. Phosphate rock is rock that consists of calcium phosphate largely in the form of apatite or carbonate apatite, usually together with calcium carbonate and other minerals, and is useful in fertilizers and is a source of phosphorus compounds. It occurs in large beds in the southeastern U.S. and in extensive deposits in Arkansas and the northwestern U.S.

The calcium phosphate is normally separated from other constituents of the ore by froth flotation, using an aqueous alkaline flotation bath on which the calcium phosphate is floated with the aid of one or more flotation agents. Most widely used flotation agents are the unsaturated fatty acids, for example, oleic acid, and the technical grades or commercial grades of naturally-occurring fatty acid mixtures having a high proportion of unsaturated fatty acids, such as tall oil, soybean oil, cottonseed oil, and linseed oil, and derivatives thereof, as well as synthetic acids. The flotation effect of the fatty acids can sometimes be enhanced by mixing in a hydrocarbon, such as diesel oil, if desired together with a nonionic emulsifier.

The unsaturated fatty acid flotation agents have the disadvantage of a poor selectivity for calcium phosphates in preference to other minerals occurring with it in the ore, and particularly calcite, calcium carbonate. The unsaturated fatty acids in fact are equally effective flotation agents for both calcium phosphate and calcium carbonate, with the result that the separation of the two is very difficult, at least when the separation is carried out under alkaline conditions.

It has been proposed in Swedish Pat. No. 326,417, patented Nov. 5, 1970, that the problem can be avoided by floating the calcite at a low pH, and thus separating it from the calcium phosphate, after which the calcium phosphate can be floated at an alkaline pH. Under such conditions, the same flotation agents can be used. However, this requires two flotation steps, and the calcium carbonate is not necessarily an economically advantageous byproduct that is worth separating, since it is available less expensively from other sources.

It has also been proposed that anionic surfactants be used as flotation agents for calcium phosphate, such as, for example, the alkyl benzene sulfonates, alkyl phosphates, alkyl sulfates and alkyl sulfosuccinamates, but these while better than the unsaturated fatty acids still do not exhibit acceptable selectivity for the calcium phosphate, and the separation is still only partial unless many repeated flotation steps are used.

In accordance with the present invention, it has been determined that certain types of amphoteric surfactants serve as preferential flotation agents for calcium phosphate, particularly in an aqueous alkaline flotation bath, in the presence of calcium carbonate. These amphoteric surfactants have the general formula:

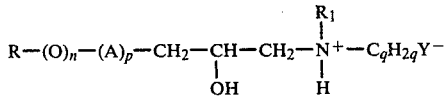

$$R-(O)_n-(A)_p-CH_2-\underset{\underset{OH}{|}}{CH}-CH_2-\overset{\overset{R_1}{|}}{\underset{\underset{H}{|}}{N}}{}^{+}-C_qH_{2q}Y^- \qquad \text{I.}$$

wherein:

R is a hydrocarbon group having from about seven to about twenty-four carbon atoms, and preferably from about ten to about eighteen carbon atoms;

A is an oxyalkylene group having from two to about four carbon atoms;

$R_1$ is selected from the group consisting of hydrogen and hydrocarbon groups having from one to about four carbon atoms;

$Y^-$ is selected from the group consisting of $COO^-$ and $SO_3^-$;

n is a number from 0 to 1;

p is a number from 0 to about 5; and q is a number from 1 to 2.

These amphoteric surfactants can be mixtures composed of a plurality of species within the stated ranges for n, p and q, and therefore these can be averages and include decimals, for instance, 0.5 and 1.5.

These amphoteric surfactants can be used in the acid form, as illustrated in the formula, or as salts with an inorganic or organic cation, at the $COO^-$ or $SO_3^-$ groups, viz:

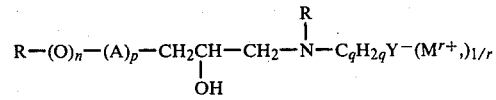

$$R-(O)_n-(A)_p-CH_2\underset{\underset{OH}{|}}{CH}-CH_2-\overset{\overset{R}{|}}{N}-C_qH_{2q}Y^-(M^{r+},)_{1/r}$$

wherein M is a cation, which can be monovalent or divalent, and inorganic or organic, and r is a number from 1 to 2.

Preferred are the compounds in which n and q are each 1 and $R_1$ is methyl. Especially preferred within this class are compounds in which R is alkylphenyl and $Y^-$ is $COO^-$.

Exemplary R hydrocarbon groups include aliphatic hydrocarbon groups, such as heptyl, isoheptyl, secondary heptyl, tertiary heptyl, octyl, isooctyl, tertiary octyl, nonyl, isononyl, tertiary nonyl, decyl, isodecyl, dodecyl, tridecyl, tetradecyl, undecyl, hexadecyl, heptadecyl, octadecyl, nonadecyl, eicosyl, docosyl, tricysyl and tetracosyl; heptenyl, octenyl, nonenyl, decenyl, undecenyl, dodecenyl, oleyl, linoleyl, linolenyl and ricinoleyl; cycloaliphatic hydrocarbon groups, such as cycloheptyl, cyclooctyl, cyclodecyl, cyclododecyl, methyl cyclohexyl, ethyl cyclopentyl, and ethyl cyclohexyl; alkyl aromatic hydrocarbon groups, such as alkyl phenyl, for example, tolyl, xylyl, mesityl, ethyl phenyl, naphthyl, butyl phenyl, octyl phenyl, nonyl phenyl, isononylphenyl, decyl phenyl, dodecyl phenyl, kerylphenyl, polypropylene phenyl, and polybutadiene phenyl.

Exemplary $R_1$ hydrocarbon groups include methyl, ethyl, propyl, isopropyl, butyl, isobutyl, tertiary-butyl, and secondary-butyl.

Exemplary A oxyalkylene groups include oxyethylene, oxypropylene-1,2, oxybutylene-1,2, oxybutylene-2,3 and mixtures of two or more thereof.

Exemplary M salt-forming inorganic cations include the alkali metals, such as sodium, potassium and lithium; ammonium; alkaline earth metal cations such as magnesium, calcium, strontium and barium; and other divalent metal cations including zinc, cadmium, cobalt, manganese, nickel and copper.

Exemplary organic cations include trimethyl amine, tributyl amine, pyridine, morpholine and piperidine.

When both n and p are zero, the compounds take the form:

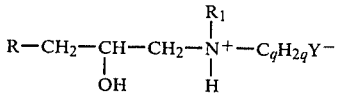

II.

Exemplary compounds of this class include:

1. 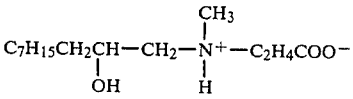

2. 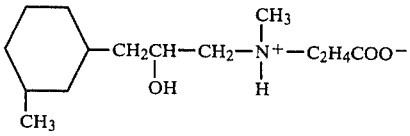

3. 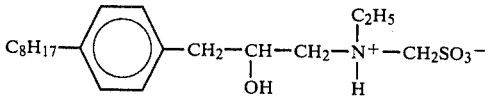

4. 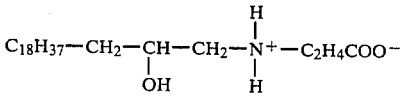

5. 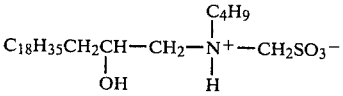

6. 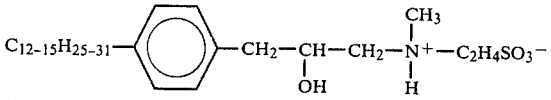

(polypropylene)

7. 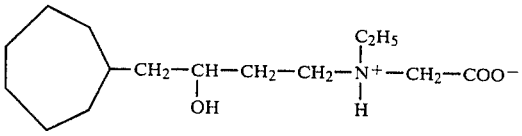

8. 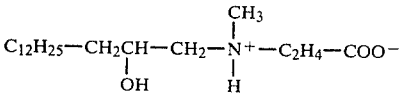

-continued

9. 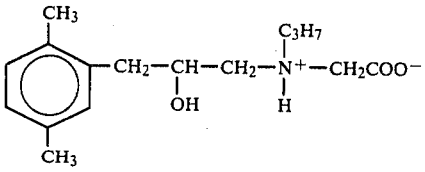

10. 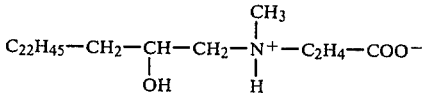

When n is 1, the compounds take the form:

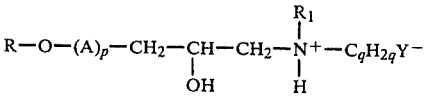

II.

Exemplary compounds of this class include:

1. 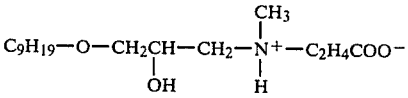

2. 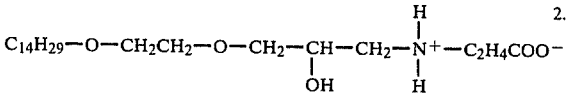

3. 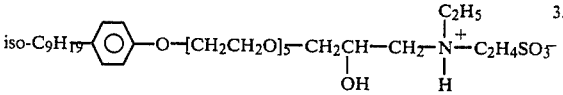

4. 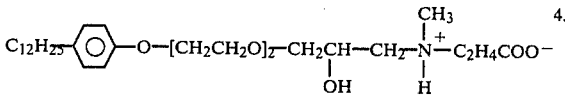

5. 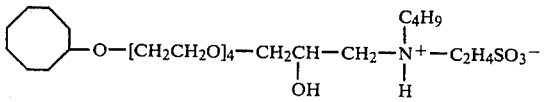

6. 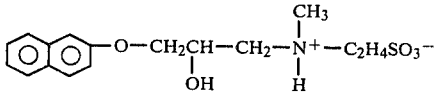

7. 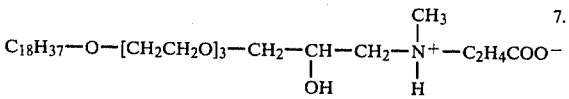

8. 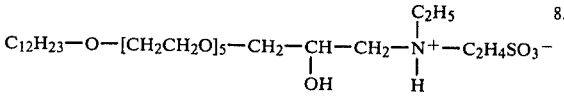

9. 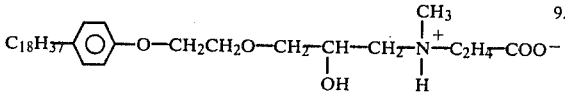

-continued

10.

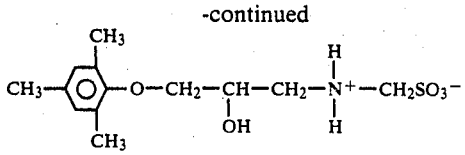

When n is 1 and p is zero, the compounds take the form:

III.

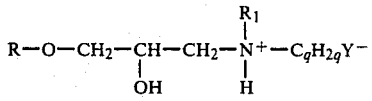

Exemplary compounds of this type include those of Class II in which p is zero, Nos. 1, 6, and 10, and the following:

1.

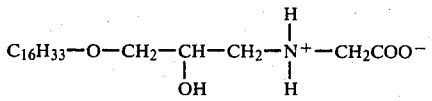

2.

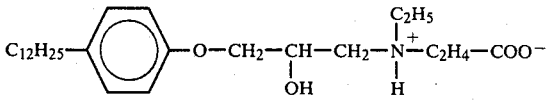

3.

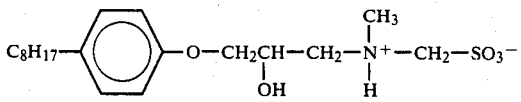

4.

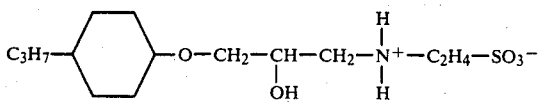

5.

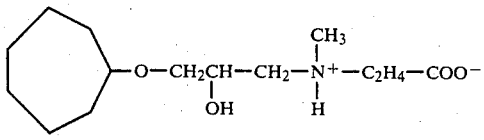

6.

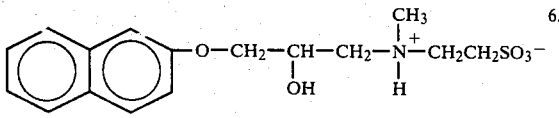

7.

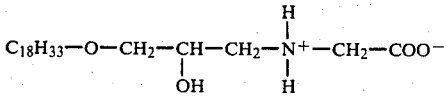

8.

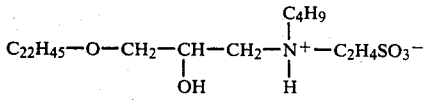

These compounds are easily produced in high yield from commercially available starting materials, using known procedures, and as flotation agents display very satisfactory selectivity and flotation properties for calcium phosphate in phosphate rock, phosphorites, and other calcium phosphate-containing ores and minerals.

By varying the chain length of the R group and the number of A groups, it is possible to adjust the relative hydrophilic and hydrophobic properties of the flotation agents of the invention, so that compounds can be obtained having a hydrophilic/hydrophobic balance that are suitable for the particular ore that is being processed. The flotation agents of the invention make it possible to process an apatite-type ore containing as little as 10% apatite and as much as 35% calcite, with the remainder silicates, to a calcium phosphate concentrate having a content of 80% apatite in an 85% yield.

One procedure for forming the flotation agents of the invention starts with an alpha-olefin having from ten to twenty-seven carbon atoms. The olefin is epoxidized using an organic peroxide, for instance, a tertiary butyl hydroperoxide or peracetic acid, at room or elevated temperature. The resulting epoxide is then reacted with an aminocarboxylic or sulfonic acid having the general formula:

A.

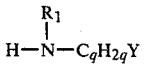

wherein $R_1$, Y and q have the same meaning as in Formula I.

The reaction between the compound and the amine is carried out either in neutral or slightly basic solution, preferably at a pH within the range from about 7 to about 10, in the presence of a polar solvent. The reaction temperature is suitably within the range from about 50 to about 140° C. Under these conditions the reaction is complete within from about ten minutes to about three hours.

Another procedure starts with the corresponding hydroxyl compound ROH or alkylene oxide adduct thereof $RO(A)_{p1}H$, where $p_1$ is 1 to 5. This compound is reacted with epichlorhydrin, and the reaction product is a chloroglyceryl ether:

B.

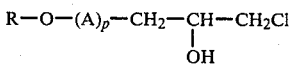

This ether is then reacted with an amine having the Formula A above.

The reaction between the hydroxyl compound ROH or the alkylene oxide adduct thereof $RO(A)_{p1}H$ and epichlorhydrin is carried out at a reaction temperature within the range from about 100° to about 150° C., in the presence of a catalyst such as tin tetrachloride, boron trifluoride and perchloric acid. Any acid catalyst can be used, however, such as toluene sulfonic acid and sulfuric acid. To ensure a complete reaction, an excess of epichlorhydrin is normally used.

The amination of the resulting chloroglyceryl ether with primary amine of the Formula A above or ammonia is carried out in the presence of alkali such as sodium hydroxide at a reaction temperature within the range from about 100° to about 150° C. This reaction is usually carried out in the presence of a polar solvent, for instance, water or a low molecular weight alcohol, such as methanol, ethanol, monoethylene glycol, diethylene glycol, ethyl diethylene glycol and ethyl ethylene glycol.

The amine of Formula A can be prepared by reaction of ammonia or a primary amine of the formula $R_1NH_2$ with a carboxylic or sulfonic acid compound having the formula $ClC_qH_{2q}Y$, wherein $R_1$, Y and q have the same meanings as above in Formula I.

The reaction of the amine with the compound $ClC_qH_{2q}Y$ is carried out in a neutralized aqueous solution, the reaction temperature being within the range from about 50° to about 100° C. The reaction is normally complete within from about two hours to about six hours. If the amine contains hydrocarbon groups and more than fourteen carbon atoms, it may also be advantageous to add an aliphatic glycol, such as ethyl diethylene glycol, in order to increase the solubility of the amine, and also reduce the viscosity of the reaction mixture.

The hydroxyl compound ROH used as a starting material may be an aliphatic alcohol having from seven to about twenty-four carbon atoms. A mixture of fatty alcohols obtained from naturally occurring fatty acid or fatty acid ester mixtures, as found in vegetable oils and animal fats, can be used, such as for example coconut oil fatty alcohols, palm oil fatty alcohols, soyabean fatty alcohols, linseed oil fatty alcohols, corn oil fatty alcohols, castor oil fatty alcohols, fish oil fatty alcohols, whale oil fatty alcohols, tallow fatty alcohols and lard fatty alcohols. Other alcohols include decyl alcohol, lauryl alcohol, myristyl alcohol, cetyl alcohol, stearyl alcohol, eicosyl alcohol, oleyl alcohol and eicosenyl alcohol, as well as the synthetic alcohol mixtures produced in the Ziegler process or the Oxo process. Alcohols manufactured according to the Oxo process have a branched chain, and occur in a large number of isomers.

Also useful are cycloaliphatic alcohols such as alkyl-substituted cyclohexanols, and the unsubstituted and alkyl-substituted cycloheptanols, cyclooctanols, cyclododecanols, and cyclohexadecanols.

Aromatic phenols and particularly monoalkyl-and dialkyl-substituted phenols are also useful, including octylphenol, nonylphenol, dodecylphenol, hexadecylphenol, kerylphenol, polypropylenephenol, dibutyphenol, dioctylphenol and dinonylphenol, and the corresponding unsubstituted and alkyl-substituted naphthols.

Suitable amines include methyl amine and ethyl amine.

The carboxylic or sulfonic acid compound $ClC_qH_{2q}Y$ should be α-monohalogenated, in order to obtain a rapid reaction with the primary amine $R_1NH_2$. Exemplary α-monohalogenated acids are monochloroacetic acid, α-monochloropropionic acid and α-monochlorobutyric acid, as well as monochloroethane sulphonic acid, α-monochloropropane sulphonic acid and α-monochlorobutane sulphonic acid.

Suitable α-amino and β-amino acids include methyl glycine, methyl alanine, methyl valine and methyl taurine.

The flotation ability of the amphoteric flotation agent can be further improved in the presence of a second hydrophobic flotation agent, which preferably is a polar water-insoluble hydrophobic compound having an affinity for the mineral particles associated with the amphoteric flotation agent of the invention.

Suitable water-insoluble polar flotation agents include the water-insoluble fatty acid soaps, such as the calcium soaps and aluminum soaps of fatty acids, and fatty acid mixtures, such as palmitic acid, myristic acid, lauric acid, stearic acid, oleic acid, linoleic acid, linolenic acid, ricinoleic acid, as such, or as in the naturally-occurring fatty acid mixtures derived from, for example, tallow, linseed oil, cottonseed oil, corn oil, soyabean oil, tung oil, sunflower seed oil, peanut oil, palm kernel oil, safflower seed oil, fish oil, coconut oil, and any of the other fatty oils and ester mixtures referred to above. Also useful are the water-insoluble polyoxyalkylene ether surfactants, such as alkyl phenol ethers of polyoxyalkylene glycols, such as the Tritons and Emulphors; mixed oxyethylene-oxypropylene condensates, such as the Pluronics; aliphatic alcohol ethers of polyoxyalkylene glycols; fatty acid esters of polyoxyalkylene glycols; fatty acid amides of polyoxyalkylene glycols; fatty alcohol ethers of polyoxyalkylene glycols; and the corresponding polyoxypropylene alcohols and glycols; organic phosphates, such as tributyl phosphate, tricresyl phosphate, tri-2-ethylhexyl phosphate, trioctyl phosphate, trinonyl phosphate; and esters of organic polycarboxylic acids, such as the tributyl ester and the tri-2-ethylhexyl ester of nitrilotriacetic acid, as well as dioctyl phthalate and dioctyl sebacate.

The amphoteric flotation agent is normally added in an amount within the range from about 50 to about 1000 g per metric ton of mineral.

The polar water-insoluble hydrophobic flotation agent is added in an amount within the range from zero to 1000 g per metric ton of mineral, and preferably from about 5 to about 750 g per metric ton of mineral. The ratio of amphoteric flotation agent to hydrophobic flotation agent can be widely varied, but is normally within the range from 1:20 to 20:1 and preferably from 1:5 to 5:1.

In order to obtain a stable aqueous emulsion of the polar water-insoluble flotation agent, an emulsifier can be added, optionally dissolved in a hydrocarbon. As the emulsifier, a nonionic surfactant can be used. If the emulsifier is water-insoluble, it can be combined with the water-insoluble polar flotation agent.

The flotation agents of the invention also can be used in conjunction with conventional aqueous flotation bath adjuncts, such as pH regulators, foam depressants, foaming agents, and activators. As in most flotation processes, the pH is of importance in obtaining a good separation. The flotation agents of the invention are best used at an alkaline pH, but since the flotation agents are amphoteric, they function both in acid and in alkaline solution, as well as in neutral solution.

The character of the amphoteric compound varies with pH, as in the case of other amphoteric compounds. In strongly acidic solutions, for example, pH 2 to 5, the amphoteric flotation agents of the invention are mainly cationic, while in strongly alkaline solutions, for example, at a pH above 10, the flotation agents of the invention are mainly anionic.

In the separation of phosphate rock containing apatite and silicate or apatite and calcite, an excellent selective enrichment with respect to calcium phosphate is obtained if the flotation is carried out at a pH within the range from about 8 to about 11, if desired in conjunction with conventional foaming agents, depressants and activators. The particular conditions chosen will of course depend upon the particular ore that is being processed.

The flotation agents of the invention are applicable to the processing of any kind of calcium phosphate-containing ore, including phosphorite ores, phosphate rock, any of the several forms of apatite referred to above, and mixtures of apatite and silicate or apatite and calcite.

In the following Examples, which in the opinion of the inventors represent preferred embodiments of the invention:

(1) Examples I to V illustrate the preparation of amphoteric flotation agents of the invention; and (2) Examples 1 to 5 illustrate the application of these flotation agents in the flotation of calcium phosphate-containing ores.

EXAMPLE I

In a reaction vessel provided with a heating coil, a stirrer and a reflux condenser for cooling, 8.8 g NaOH was first dissolved in 40 ml of water and then 120 g of ethanol was added. In the alkaline solution 20 g (0.22 mole) N-methylglycine in acid form was dissolved, and then 44 g (0.20 mole) of α-olefin oxide was added drop by drop over a period of thirty minutes with stirring. The α-olefin oxide was a 1,2-epoxide of an n-alkane composed of a mixture of straight and branched alkyl groups having from about ten to about thirteen carbon atoms and having the formula:

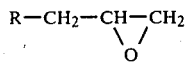

The reaction mixture was heated at 60° to 70° C. for 1.5 hours with stirring. At the beginning of the reaction the mixture was cloudy, but after 1.5 hours the mixture had become clear and homogeneous. The mixture was then transferred from the reaction vessel to an evaporator, where a major part of the ethanol and part of the water was evaporated under vacuum. More water was added and a second partial distillation of alcohol and water carried out. The product obtained was an aqueous, clear, almost colorless solution having a solids content of 23% of a compound shown by analysis to have the formula:

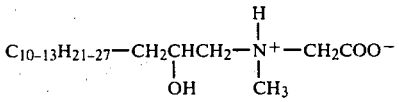

Two phase titration with cetyl trimethyl ammonium bromide, a cationic surface-active compound, at a pH of 10 indicated that the yield was 69%, based on the starting α-olefin epoxide.

EXAMPLE II

In a reaction vessel provided with heating coil, stirrer and reflux condenser for cooling, 9 g NaOH was dissolved in 20 ml water. Then 33 g ethanol, 8.91 g (0.11 mole) N-methyl glycine in acid form, and 34 g (0.10 mole) cetyl chloroglyceryl ether, $C_{16}H_{33}OCH_2CH(OH)CH_2Cl$, were added. The reaction mixture was held at 60° to 70° C. with stirring for two hours fifteen minutes. The cloudy liquid obtained was filtered at elevated temperature and 6.7 g of crystals, mainly sodium chloride, was separated. The reaction product was found by analysis to have the formula:

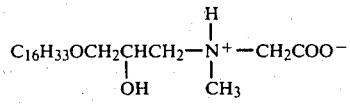

The two-phase titration with cetyl trimethyl ammonium bromide, a cationic surface-active compound, at a pH of 10 showed that the yield was 66%, based on the chloroglyceryl ether.

EXAMPLE III

By reaction of epichlorhydrin with the adduct of 1 mole nonylphenol and 2 moles ethylene oxide in the presence of tin tetrachloride as a catalyst, the following chloroglyceryl ether was prepared:

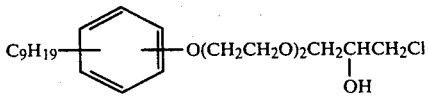

In a reaction vessel provided with heating coil, stirrer and reflux condenser for cooling, 16.1 g (0.25 mole) of 87% aqueous potassium hydroxide solution was dissolved in 60 g propylene glycol, and 27.8 g (0.25 mole) of the sodium salt of N-methyl glycine was then added.

The resulting solution was heated to 80° C., and 103 g (0.25 mole) of the above chloroglyceryl ether was added drop by drop. The reaction mixture was then held at 80° C. for two hours. The reaction product was a pale yellow cloudy liquid, found by analysis to have the formula:

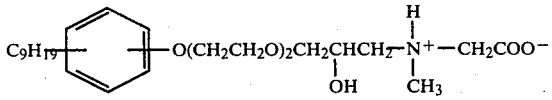

The product was titrated with cetyl trimethyl ammonium bromide, a cationic surface-active agent, at a pH of 10, and the yield determined to be 68%, based on the chloroglyceryl ether.

EXAMPLE IV

In a reaction vessel provided with heating coil, reflux condenser for cooling, and stirrer, 10 ml of water, 4.8 g (0.12 mole) NaOH and 30 g ethanol were added. The sodium hydroxide was dissolved and then there was added 15 g (0.12 mole) of taurine, $H_2NCH_2CH_2SO_3H$, and 27 g of an epoxide having the formula:

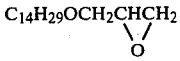

The mixture was then heated at 70° C. for two hours. The reaction product, a pale yellow clear solution, was found by analysis to have the formula:

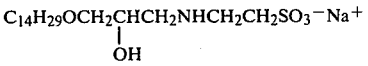

The product was titrated with cetyl trimethyl ammonium bromide, a cationic surface-active agent, at a pH of 10, and the yield determined to be 63%, based on the epoxide.

EXAMPLE V

In a reaction vessel provided with heating coil, reflux condenser for cooling, and a stirrer, 5 g (0.12 mole) NaOH was dissolved in 21 ml of water, and then 14 g (0.1 mole) of N-methyl taurine was added and dissolved. To this mixture was added 31 g (0.1 mole) of myristyl chloroglyceryl ether having the formula:

$$C_{14}H_{29}OCH_2\underset{\underset{OH}{|}}{C}HCH_2Cl$$

Then, an additional 5 g (0.1 mole) of NaOH was added, as well as 37.3 g ethanol. The mixture was heated at 80° C. for 3.5 hours, and the hot solution filtered. 5.1 g of sodium chloride were separated. The filtrate was a yellow clear solution, determined by analysis to contain $$C_{14}H_{29}OCH_2\underset{\underset{OH}{|}}{C}HCH_2\underset{\underset{CH_3}{|}}{N}CH_2CH_2SO_3^-Na^+$$

A sample of the filtrate was titrated with cetyl trimethyl ammonium bromide, a cationic surface-active compound, at a pH of 10, and the yield found to be 66%, based on the chloroglyceryl ether.

The above flotation agents were then used to process various types of calcium phosphate ore, as described in Examples 1 to 5.

EXAMPLE 1

A calcium phosphate ore (containing 9.9% by weight fluoroapatite, 37% by weight calcite $CaCO_3$, and the rest silicate minerals) was crushed into nuggets about 1 cm in diameter, and homogenized. 1 kg of the homogenized material was removed and ground for five minutes with 0.8 liter of water. About 80% by weight of the ground material passed through a 280 μm mesh sieve.

After grinding, the ore was suspended in a total volume of 2.2 liters of water, and the suspension then poured into a graduated cylinder. After settling for five minutes, the water and the mud above the one liter mark were removed. The solids content in the mud was 64 g, in 1000 cc, i.e., 6.4% by weight. The pH of the suspension was alkaline, about 9.9.

From the remaining 936 g of ore and water, a mineral pulp was prepared with a total volume of 2 liters. The pulp was conditioned for ten minutes in the presence of 250 ml of the amphoteric compound of Example I having the formula:

$$C_{10\text{-}13}H_{21\text{-}27}-CH_2\underset{\underset{OH}{|}}{C}HCH_2-\overset{\overset{H}{|}}{\underset{\underset{CH_3}{|}}{N}}^+-CH_2COO^-$$

Flotation was then carried out in a cell having a volume of 2 liters, followed by four flotations in a cell having a volume of 1 liter. The degree of separation was then determined by determining the proportional amounts of apatite and calcite floated, and the amount of residue, with the following results:

TABLE I

| | pH | Apatite Proportion % | Apatite Yield[1] % | Calcite Proportion % | Calcite Yield % | Residue % |
|---|---|---|---|---|---|---|
| Starting ore | | | | | | |
| After first Flotation | 9.9 | 46.2 | 96.6 | 44.1 | 26.1 | 9.1 |
| Repeat 1 | 9.7 | 57.6 | 94.0 | 38.0 | 17.3 | 4.4 |
| Repeat 2 | 9.5 | 67.9 | 90.7 | 28.9 | 10.8 | 3.2 |
| Repeat 3 | 9.3 | 79.4 | 85.9 | 18.2 | 5.6 | 2.4 |
| Repeat 4 | 9.2 | 88.6 | 71.1 | 8.0 | 1.8 | 3.4 |

[1]Yield was calculated on the demudded ore.

It is apparent from the results in Table I that the flotation agent of the invention gives a very good separation of apatite from calcite in flotation at the natural pH value of the pulp, which is within the range from 9.9 to 9.2. The ratio of apatite to calcite in the starting pulp was 0.27, but after the fourth repeat the ratio was 11.

EXAMPLE 2

Another portion of the ore of Example I was crushed, homogenized and ground as in Example 1.

After the grinding, a pulp was prepared of the ore and water to a total volume of 2 liters. The pulp was conditioned in a flotation cell for five minutes in the presence of 100 mg of the flotation agent of Example II, having the formula:

$$C_{16}H_{33}-O-CH_2\underset{\underset{OH}{|}}{C}HCH_2-\overset{\overset{H}{|}}{\underset{\underset{CH_3}{|}}{N}}^+-CH_2COO^-$$

Flotation was then carried out in a cell having a volume of 2 liters. When needed, a foaming agent of the polypropylene glycol type was added. The total amount of polypropylene glycol added was 85 mg. The total pH value of the pulp during the flotation was within the range from 9.7 to 9.2. Following the first flotation, four repeat flotations were carried out in a cell having a volume of 1 liter. The following results were obtained:

TABLE II

| | pH | Apatite Proportion % | Apatite Yield % | Calcite Proportion % | Calcite Yield % | Residue % |
|---|---|---|---|---|---|---|
| Starting ore | | | | | | |
| After first Flotation | 9.9 | 35.7 | 83.6 | 42.3 | 27.3 | 22.0 |
| Repeat 1 | 9.7 | 46.5 | 87.5 | 43.2 | 21.2 | 10.3 |
| Repeat 2 | 9.5 | 54.1 | 86.4 | 40.0 | 16.7 | 5.9 |
| Repeat 3 | 9.3 | 63.9 | 82.7 | 31.1 | 10.5 | 5.1 |
| Repeat 4 | 9.2 | 75.1 | 78.7 | 19.5 | 5.4 | 5.4 |

The results show that after four repeats the apatite content in the floated material was 75.1%, as compared with 9.9% in the starting ore. The calcite content simultaneously decreased, from 37% to 5.4%.

EXAMPLE 3

Another portion of the same ore as in Example I was crushed, homogenized and ground as in Example 1.

After the grinding, a pulp was prepared of the ore and water with a total volume of 2 liters. The pulp was then conditioned in a flotation cell for five minutes with 188.5 mg of a 40:60 mixture of the flotation agent of Example III together with a like flotation agent without the 2-hydroxy propylene N-methyl glycine group, having the formulae:

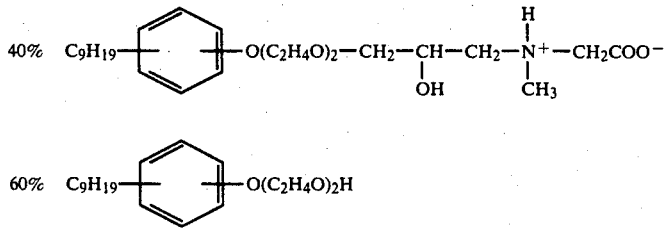

A flotation was then carried out in a cell having a volume of 2 liters, followed by two repeats in a cell having a volume of 1 liter. During the flotations, the pH value was within the range from about 9.6 to about 8.8. Following the second repeat an apatite proportion of 84.9% in the floated material was obtained, in a yield of 91.1%.

EXAMPLE 4

Waste material (1 kg) from magnetically enriched iron ore containing about 10.8% apatite, the remainder iron minerals and silicates, was ground in the presence of 0.8 liter water for five minutes. About 80% by weight of the ground material passed through a 178 μm mesh sieve.

After grinding, a pulp was prepared of the ore and water with a total volume of 2 liters. The pulp was then conditioned for five minutes with 400 mg of the flotation agent of Example IV, having the formula:

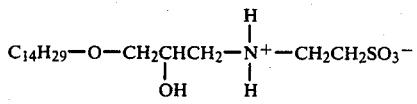

A flotation was then carried out in a 2 liter cell. The apatite proportion in the float obtained was 83.2% in a yield of 98.4%, as compared to 10.8% in the starting ore.

EXAMPLE 5

Waste material from magnetically enriched iron ore was processed, having the following composition:

TABLE III

| | Percent |
|---|---|
| Apatite | 40.0 |
| Fe | 7.4 |
| $Fe^{++}$ | 1.7 |
| S | 0.13 |
| Calcite | 7.0 |

1 kg of this material was ground for five minutes in the presence of 0.8 liter of water. Before the grinding, 80% of the material passed through a 100 μm mesh sieve.

After the grinding, a pulp was prepared of the ore in 2 liters of water. The pulp was conditioned for five minutes with 800 mg of a 50:50 mixture of the flotation agent of Example V, together with a nonionic agent without the 2-hydroxy propylene N-methyl taurine group, and having the composition:

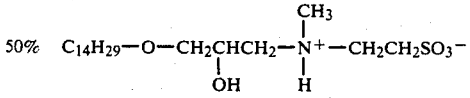

-continued

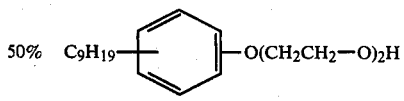

A flotation was carried out with three repeats in a cell having a volume of 2 liters with the following results:

TABLE IV

| | pH | Apatite Proportion % | Apatite Yield % | Calcium Proportion % | Calcium Yield % | Residue % |
|---|---|---|---|---|---|---|
| Starting ore | | 40.0 | — | 7.0 | — | 53.0 |
| After first Flotation | 9.9 | 69.2 | 96.6 | 8.0 | 75.0 | 22.8 |
| Repeat 1 | 9.6 | 80.5 | 91.7 | 7.5 | 57.9 | 12.0 |
| Repeat 2 | 9.3 | 83.2 | 88.5 | 7.3 | 52.8 | 9.5 |
| Repeat 3 | 9.2 | 84.3 | 85.1 | 7.0 | 48.0 | 8.7 |

The results show that the apatite was enriched to a concentration of 84.3% in a yield of 85.1% at the end of the third repeat. The calcite concentration was reduced to only 7% in a yield of 48%. The remaining components were reduced from 53% to 8.7%.

Having regard to the foregoing disclosure, the following is claimed as inventive and patentable embodiments thereof:

1. A process for the froth flotation of calcium phosphate-containing materials in an aqueous flotation bath while preferentially and selectively floating calcium phosphate in the presence of any calcium carbonate, which comprises carrying out the flotation in the presence of an amphoteric surfactant having the formula:

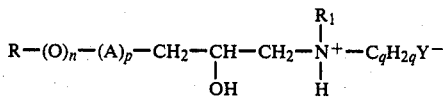

wherein:

R is a hydrocarbon group having from about seven to about twenty-four carbon atoms;

A is an oxyalkylene group having from two to about four carbon atoms;

$R_1$ is selected from the group consisting of hydrogen and hydrocarbon groups having from one to about four carbon atoms;

$Y^-$ is selected from the group consisting of $COO^-$ and $SO_3^-$;

n is a number from 0 to 1;

p is a number from 0 to about 5; and q is a number from 1 to 2.

2. A process according to claim 1 in which R has from ten to about eighteen carbon atoms.

3. A process according to claim 1 in which the amphoteric surfactant is in the salt form having the formula:

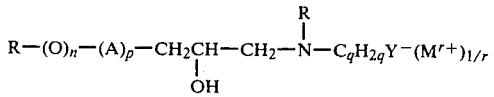

wherein $M^{r+}$ is a cation selected from the group consisting of monovalent and divalent inorganic and organic cations, and r is a number from 1 to 2.

4. A process according to claim 1 in which $Y^-$ is $COO^-$.

5. A process according to claim 1 in which $Y^-$ is $SO_3^-$.

6. A process according to claim 1 in which n and q are each 1 and $R_1$ is methyl.

7. A process according to claim 6 in which R is alkylphenyl and $Y^-$ is $COO^-$.

8. A process according to claim 1 in which the R hydrocarbon group is an aliphatic hydrocarbon group.

9. A process according to claim 1 in which the R hydrocarbon group is a cycloaliphatic hydrocarbon group.

10. A process according to claim 1 in which the R hydrocarbon group is an alkyl aromatic hydrocarbon group.

11. A process according to claim 10 in which R is alkyl phenyl.

12. A process according to claim 1 in which the oxyalkylene group is oxyethylene.

13. A process according to claim 1 in which both n and p are zero and the amphoteric surfactant has the formula:

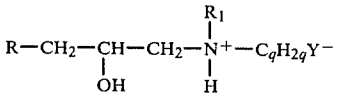

14. A process according to claim 1 in which n is 1 and the amphoteric surfactant has the formula:

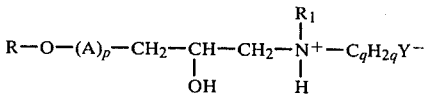

15. A process according to claim 1 in which n is 1 and p is zero, and the amphoteric surfactant has the formula:

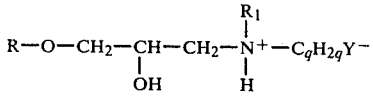

16. A process according to claim 1 in which a polar water-insoluble second flotation agent is added selected from the group consisting of water-insoluble fatty acid soaps, water-insoluble polyoxyalkylene ether surfactants, mixed oxyethylene-oxypropylene condensates, aliphatic alcohol ethers of polyoxyalkylene glycols, fatty acid esters of polyoxyalkylene glycols, fatty acid amides of polyoxyalkylene glycols, fatty alcohol ethers of polyoxyalkylene glycols, polyoxypropylene alcohols and glycols, organic phosphates, and esters of organic polycarboxylic acids having an affinity for calcium phosphate.

17. A process according to claim 16 in which the polar water-insoluble flotation agent is a water-insoluble nonionic surface-active alkylene oxide adduct.

18. A process according to claim 1 in which the amphoteric surfactant is added in an amount within the range from about 50 to about 1000 g per metric ton of mineral.

19. A process according to claim 18 in which a polar water-insoluble second flotation agent is added in an amount within the range from 0.1 to about 1000 g per metric ton of mineral.

20. A process according to claim 19 in which the ratio of amphoteric surfactant to the second flotation agent is from 1:20 to 20:1.

21. A process according to claim 20 in which the ratio of amphoteric surfactant to the second flotation agent is from 1:5 to 5:1.

22. A process according to claim 1 in which the flotation is carried out at a pH of from 8 to 11.

23. A flotation agent composition comprising an amphoteric surfactant having the formula:

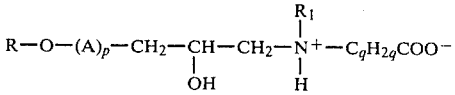

wherein:

R is a hydrocarbon group having from about seven to about twenty-four carbon atoms;

A is an oxyalkylene group having from two to about four carbon atoms;

$R_1$ is selected from the group consisting of hydrogen and hydrocarbon groups having from one to about four carbon atoms;

p is a number from 0 to about 5; and q is a number from 1 to 2; and a second polar water-insoluble flotation agent selected from the group consisting of water-insoluble fatty acid soaps, water-insoluble polyoxyalkylene ether surfactants, mixed oxyethylene-oxypropylene condensates, aliphatic alcohol ethers of polyoxyalkylene glycols, fatty acid esters of polyoxyalkylene glycols, fatty acid amides of polyoxyalkylene glycols, fatty alcohol ethers of polyoxyalkylene glycols, polyoxypropylene alcohols and glycols, organic phosphates, and esters of organic polycarboxylic acids having an affinity for calcium phosphate.

* * * * *